US011052676B2

(12) United States Patent
Ozawa

(10) Patent No.: US 11,052,676 B2
(45) Date of Patent: Jul. 6, 2021

(54) PRINTING DEVICE, CONTROL METHOD, AND NON-TRANSITORY RECORDING MEDIUM

(71) Applicant: CASIO COMPUTER CO., LTD., Tokyo (JP)

(72) Inventor: Takeo Ozawa, Mitaka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 270 days.

(21) Appl. No.: 16/259,996

(22) Filed: Jan. 28, 2019

(65) Prior Publication Data

US 2019/0283455 A1 Sep. 19, 2019

(30) Foreign Application Priority Data

Mar. 15, 2018 (JP) ..... JP2018-047394

(51) Int. Cl.
*B41J 3/407* (2006.01)
*B41J 2/335* (2006.01)
(Continued)

(52) U.S. Cl.
CPC ..... *B41J 3/4075* (2013.01); *B41J 2/325* (2013.01); *B41J 2/335* (2013.01); *B41J 11/003* (2013.01);
(Continued)

(58) Field of Classification Search
CPC . B41J 2/325; B41J 2/335; B41J 3/4075; B41J 11/003; B41J 11/009; B41J 11/04; B41J 11/42; B41J 11/703
See application file for complete search history.

(56) References Cited

U.S. PATENT DOCUMENTS 6,106,276 A * 8/2000 Sams ..... F23D 14/46 126/110 C
6,129,462 A * 10/2000 Furuya ..... B41J 3/4075 400/61
(Continued)

FOREIGN PATENT DOCUMENTS

JP 07-125344 * 10/1993 ..... B41J 11/70
JP H07125344 A 5/1995
(Continued)

OTHER PUBLICATIONS

Japanese Office Action dated Oct. 8, 2019 (and English translation thereof) issued in Japanese Patent Application No. 2018-047394.
(Continued)

*Primary Examiner* — Matthew G Marini
*Assistant Examiner* — Marissa Ferguson-Samreth
(74) *Attorney, Agent, or Firm* — Holtz, Holtz & Volek PC

(57) ABSTRACT

A printing device 1 includes a platen roller 7 which feeds a thermal tape 42, a thermal head 8 which performs printing on the thermal tape 42, and a control circuit 12. The control circuit 12 rotates the platen roller 7 backward to feed the thermal tape 42 backward in order to make a printing start area PT of the thermal tape 42 reach a backward feed position more away from an outlet 2*b* than a normal position NP of the thermal head 8. After that, the control circuit 12 rotates the platen roller 7 forward to perform printing using the thermal head 8.

10 Claims, 8 Drawing Sheets

(51) Int. Cl.

| | |
|---|---|
| ***B41J 11/42*** | (2006.01) |
| ***B41J 11/04*** | (2006.01) |
| ***B41J 11/70*** | (2006.01) |
| ***B41J 2/325*** | (2006.01) |
| ***B41J 11/00*** | (2006.01) |

(52) U.S. Cl.
CPC ..... *B41J 11/009* (2013.01); *B41J 11/04* (2013.01); *B41J 11/42* (2013.01); *B41J 11/703* (2013.01)

(56) References Cited

U.S. PATENT DOCUMENTS

| | | | | | |
|---|---|---|---|---|---|
| 6,142,688 | A * | 11/2000 | Saito | B26D 1/305 400/621 |
| 6,874,962 | B2 | 4/2005 | Shibata et al. | |
| 9,487,035 | B2 * | 11/2016 | Wakayama | H04N 1/00676 |
| 10,232,643 | B2 * | 3/2019 | Ozawa | B41J 11/003 |
| 2019/0291478 | A1 * | 9/2019 | Ozawa | B41J 3/4075 |

FOREIGN PATENT DOCUMENTS

| | | | | |
|---|---|---|---|---|
| JP | 07-251539 | * | 10/1995 | B41J 11/70 |
| JP | H07251539 | A | 10/1995 | |
| JP | 08-25707 | * | 1/1996 | B41J 3/36 |
| JP | 2004-216692 | * | 8/2004 | B41J 11/70 |
| JP | 2008036894 | A | 2/2008 | |
| JP | 2011161895 | A | 8/2011 | |
| JP | 2012179882 | A | 9/2012 | |
| JP | 2017149161 | A | 8/2017 | |
| WO | 03011602 | A1 | 2/2003 | |

OTHER PUBLICATIONS

Japanese Office Action dated Feb. 4, 2020 (and English translation thereof) issued in Japanese Application No. 2018-047394.

* cited by examiner

PRINTING DEVICE, CONTROL METHOD, AND NON-TRANSITORY RECORDING MEDIUM

CROSS-REFERENCE TO RELATED APPLICATION

This application is based upon and claims the benefit of priority from the prior Japanese Patent Application No. 2018-047394, filed Mar. 15, 2018, the entire contents of which are incorporated herein by reference.

BACKGROUND

1. Technical Field

This technical field relates to a printing device, a control method, and a non-transitory recording medium.

2. Description of the Related Art

Conventionally, there is known a label printer for printing characters, figures, and the like on a long print medium and cutting the print medium after being printed by using a cutting mechanism to create a label.

In the label printer, although a print head and the cutting mechanism are both provided on a feeding path of the print medium, the cutting mechanism is arranged downstream of the feeding direction in a position a certain distance away from the print head due to the space constraints. Therefore, when a platen roller is rotated only in the forward direction, a wasted margin, which is sized according to the distance between a printing position and a cutting position, is left at the tip of the print medium due to a difference between the printing position and the cutting position inside the label printer.

A technique related to such a problem is described, for example, in Japanese Patent Application Laid-Open No. 2012-179882, in which a label printer can rotate the platen roller in the backward direction to feed the print medium backward before the print head starts printing, so that the wasted margin can be reduced.

When the platen roller is rotated in the backward direction, stress is applied to the print head in a direction different from the case when the platen roller is rotated in the forward direction. Therefore, the print head may move to a position slightly deviated from a normal printing position (hereinafter referred to as a normal position) designed as a printing position. The deviation of the print head from the normal position can affect the printing result.

SUMMARY

According to one aspect of the present invention, there is provided a printing device including: a feeding roller which feeds a print medium; a print head which performs printing on the print medium; and a control unit, wherein the control unit rotates the feeding roller backward to feed the print medium backward in order to make a printing start area of the print medium reach a backward feed position more away from an outlet than a normal position of the print head, and then rotates the feeding roller forward to perform printing using the print head.

According to another aspect of the present invention, there is provided a control method executed by a printing device including: a feeding roller which feeds a print medium; a print head which performs printing on the print medium; and a control unit, the method including the steps of: causing the control unit of the printing device to rotate the feeding roller backward so as to feed the print medium backward in order to make a printing start area of the print medium reach a backward feed position more away from an outlet than a normal position of the print head; and after the above step, causing the control unit to rotate the feeding roller forward in order to perform printing using the print head.

According to still another aspect of the present invention, there is provided a non-transitory recording medium recording a computer-readable program executed by a printing device including: a feeding roller which feeds a print medium; a print head which performs printing on the print medium; and a processor, the program causing the control unit to execute the processes of: rotating the feeding roller backward to feed the print medium backward in order to make a printing start area of the print medium reach a backward feed position more away from an outlet than a normal position of the print head; and after execution of the above process, rotating the feeding roller forward to perform printing using the print head.

BRIEF DESCRIPTION OF THE SEVERAL VIEWS OF THE DRAWING

For a better understanding of this application, reference is made to the following detailed description considered in conjunction with the accompanying drawings.

DETAILED DESCRIPTION

Figure 1:
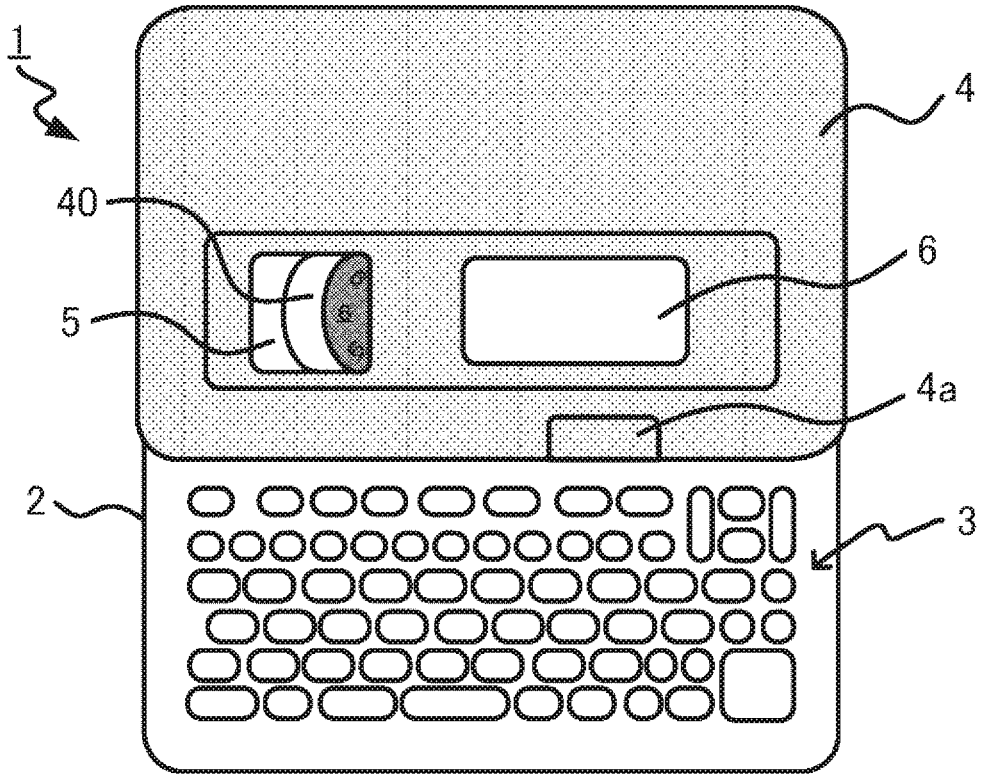
FIG. 1 is a plan view of a printing device 1 in a state where a cover 4 is closed.
Figure 2:
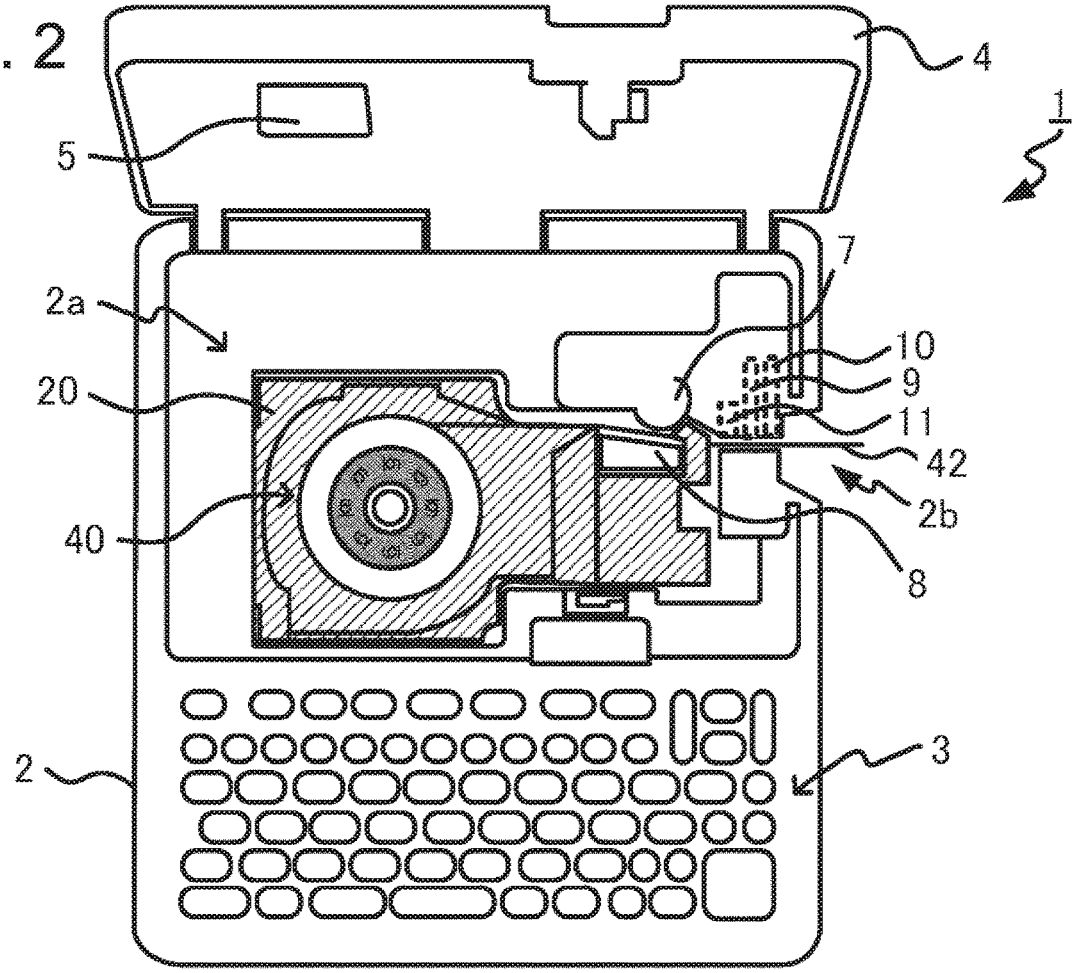
FIG. 2 is a plan view of the printing device 1 in a state where the cover 4 is open.

FIG. 1 is a plan view of a printing device 1 in a state where a cover 4 is closed. FIG. 2 is a plan view of the printing device 1 in a state where the cover 4 is open. The structure of the printing device 1 will be described below with reference to FIG. 1 and FIG. 2.

The printing device 1 is a label printer which performs printing on a thermal tape 42 contained in a print medium 40. A thermal label printer using the thermal tape 42 is described below by way of example, but the printing method is not particularly limited. The printing device 1 may be a thermal-transfer label printer using an ink ribbon. Further, the printing device 1 may perform printing in the form of single-path (one-path) routing or multipath routing (scanning).

As illustrated in FIG. 1, the printing device 1 includes a device housing 2, an input unit 3, the openable and closable cover 4, a window 5, and a display unit 6. Further, though not illustrated, a power cord connection terminal, an external device connection terminal, a storage media insertion slot, and the like are provided in the device housing 2.

The input unit 3 is provided on the upper face of the device housing 2. The input unit 3 includes various keys such as input keys, a cross key, a conversion key, and an enter key. The cover 4 is arranged above the device housing 2. A user can press a button 4*a* down to release a lock mechanism in order to open the cover 4 as illustrated in FIG. 2. The window 5 is formed in the cover 4 so that the user can visually confirm whether the print medium 40 is housed in the printing device 1 even in the closed state of the cover 4. The cover 4 also has the display unit 6.

The display unit 6 is, for example, a liquid crystal display, an organic EL (electro-luminescence) display, or the like. The display unit 6 displays characters and the like input from the input unit 3, selection menus for various settings, messages related to various processing, and the like. Note that the display unit 6 may be a display with a touch panel thereon, or the display unit 6 may function as part of the input unit 3.

As illustrated in FIG. 2, the device housing 2 includes, below the cover 4, a medium adapter storage part 2*a*, a platen roller 7, and a thermal head 8. In the medium adapter storage part 2*a*, a medium adapter 20 with the print medium 40 contained therein is stored. Further, the device housing 2 includes a full cutter 9, a half cutter 10, and a photo sensor 11 between an outlet 2*b*, from which the thermal tape 42 is ejected, and the thermal head 8. The half cutter 10, the full cutter 9, and the photo sensor 11 are arranged in this order as seen from the side of the outlet 2*b*. The medium adapter 20 and the print medium 40 will be described later.

The platen roller 7 is a feeding roller which feeds the print medium 40, and more specifically, it feeds the thermal tape 42. The platen roller 7 rotates by the rotation of a feeding motor 32 (see FIG. 6). The feeding motor 32 is, for example, a stepping motor, a direct-current (DC) motor, or the like. The platen roller 7 rotates while sandwiching the thermal tape 42, sent out from the medium adapter 20, with the thermal head 8 to feed the thermal tape 42 in the feeding direction.

The thermal head 8 is a print head which performs printing on the print medium 40, and more specifically, it performs printing on the thermal tape 42. The thermal head 8 has multiple heating elements 8*a* (see FIG. 6) in a main scanning direction perpendicular to the feeding direction of the thermal tape 42 to heat the thermal tape 42 using the heating elements 8*a* so as to perform printing one line by one line.

The full cutter 9 is a cutting mechanism for performing a full cut to cut the thermal tape 42 so as to create a tape piece. Note that the full cut means operation for cutting all layers that compose the thermal tape 42 along the width direction of the thermal tape 42.

The half cutter 10 is a cutting mechanism for performing a half cut to make a cut in the thermal tape 42. Note that the half cut means operation for cutting layers except a separator L1 (see FIG. 5) to be described later in the thermal tape 42 along the width direction thereof.

The photo sensor 11 is a sensor arranged on the feeding path of the thermal tape 42 to detect the tip of the thermal tape 42. The photo sensor 11 includes, for example, a light-emitting element and a light-receiving element. The light-emitting element is, for example, a light-emitting diode, and the light-receiving element is, for example, a photodiode. The photo sensor 11 has the light-receiving element detect the reflected light emitted from the light-emitting element to output a signal to a control circuit 12 (see FIG. 6) to be described later. The control circuit 12 detects the tip of the thermal tape 42, for example, based on a change in the amount of reflected light detected by the light-receiving element. Note that the photo sensor 11 is not limited to a photo reflector which detects the reflected light emitted from the light-emitting element. The photo sensor 11 may be a photo interrupter in which the light-emitting element and the light-receiving element are arranged opposite to each other.

Figure 3:
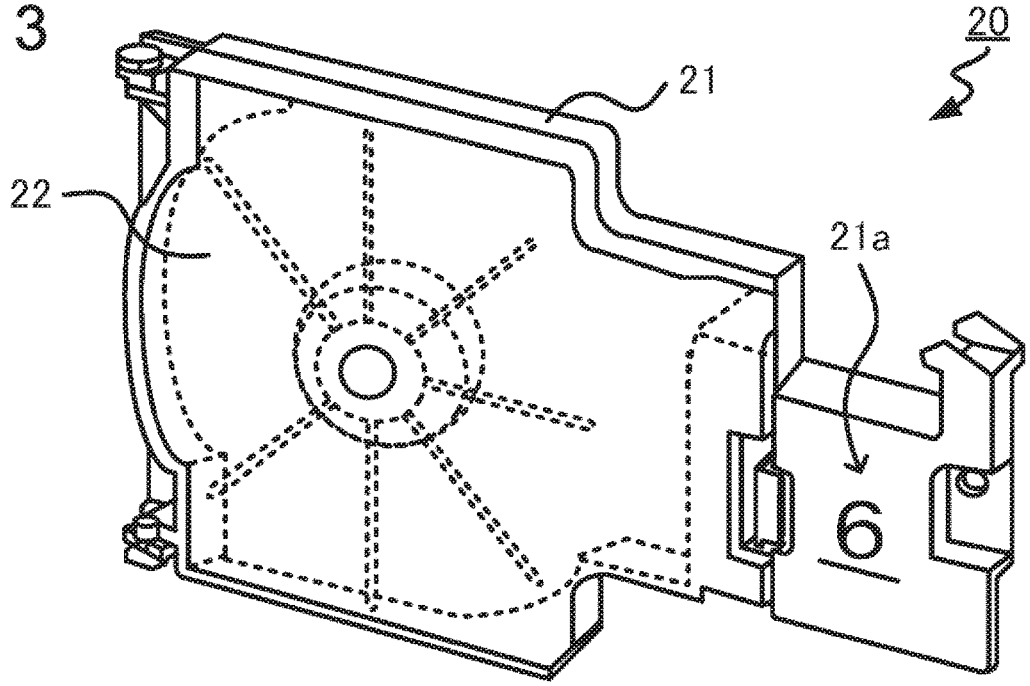
FIG. 3 is a perspective view of a medium adapter 20.
Figure 4:
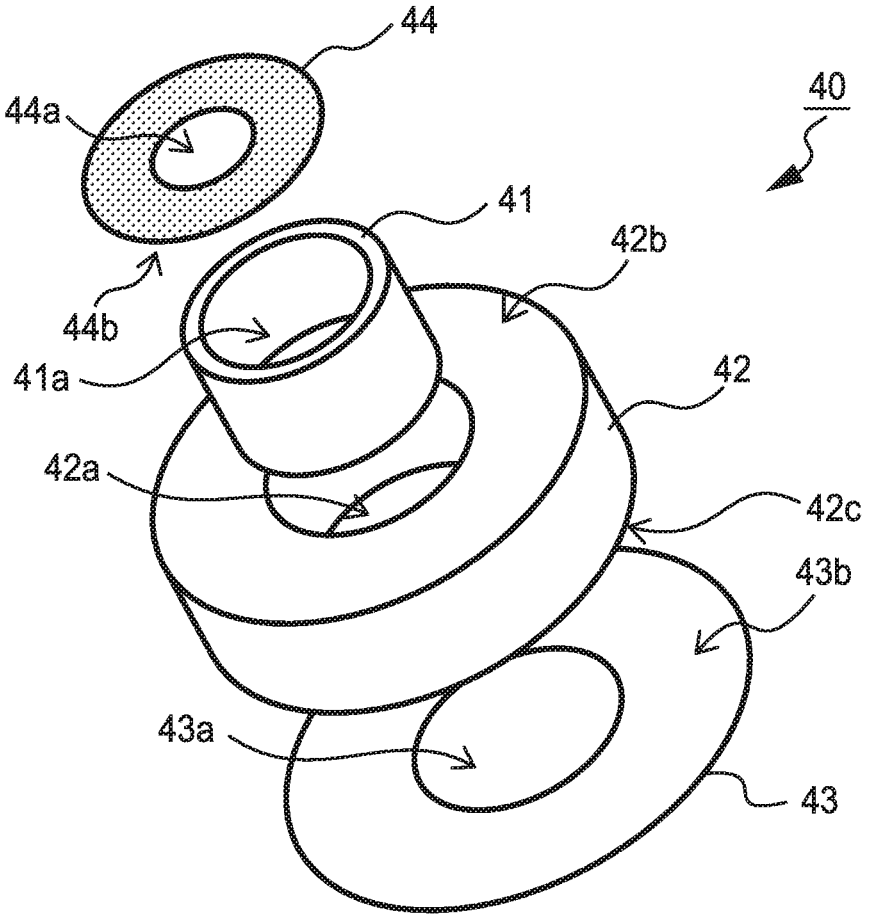
FIG. 4 is a diagram for describing the structure of a print medium 40.
Figure 5:
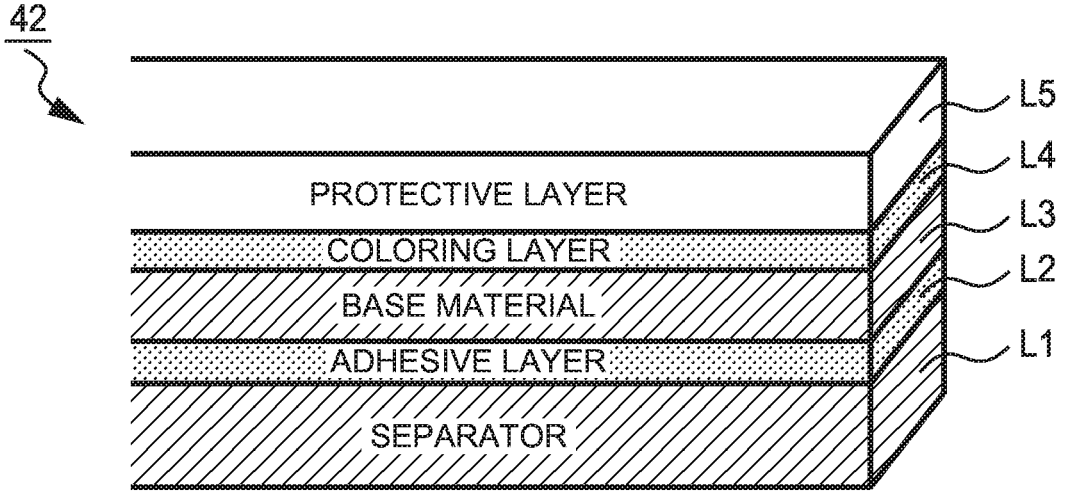
FIG. 5 is a diagram for describing the structure of a thermal tape 42.

FIG. 3 is a perspective view of the medium adapter 20. FIG. 4 is a diagram for describing the structure of the print medium 40. FIG. 5 is a diagram for describing the structure of the thermal tape 42. The structure of the medium adapter 20 and the structure of the print medium 40 will be described below with reference to FIG. 3 to FIG. 5.

The medium adapter 20 is a medium adapter for storing the print medium 40 to store the print medium 40 in such a manner that the user can replace the print medium 40. In other words, the medium adapter 20 is designed on the assumption that the user takes the print medium 40 in and out of the medium adapter 20.

As illustrated in FIG. 3, the medium adapter 20 includes an adapter body 21 and an adapter cover 22 attached to the adapter body 21 openably and closably. The print medium 40 is stored in the internal space of the medium adapter 20 partitioned by the adapter body 21 and the adapter cover 22.

Further, the medium adapter 20 is designed to fit the tape width of the thermal tape 42 contained in the print medium 40. The tape width of the thermal tape 42 to be stored in the medium adapter 20 is indicated in an area 21*a* of the adapter body 21. In this example, the medium adapter 20 is a medium adapter for a tape with a tape width of 6 mm.

Since the medium adapter 20 with the print medium 40 stored therein is housed in the printing device 1, the print medium 40 is housed in the printing device 1. Note that the printing device 1 can house medium adapters corresponding to different tape widths. Specifically, for example, the printing device 1 can house, in addition to the medium adapter 20 for 6 mm tape illustrated in FIG. 3, a medium adapter for 9 mm tape, a medium adapter for 12 mm tape, a medium adapter for 18 mm tape, and the like.

As illustrated in FIG. 4, the print medium 40 includes a paper tube 41, the thermal tape 42, a loosening prevention sheet 43, and an attention sheet 44.

The paper tube 41 is a cylindrical member around which the thermal tape 42 is wound and which has a hollow portion 41*a*. The thermal tape 42 is a printing tape member wound in the longitudinal direction and formed into a cylindrical shape, which is wound to form a hollow portion 42*a*. The loosening prevention sheet 43 is an adhesive sheet stuck on one (side face 42*c*) of the side faces of the cylindrical shape of the thermal tape 42. The attention sheet 44 is an adhesive sheet stuck on the other (side face 42*b*) of the cylindrical shape of the thermal tape 42.

The paper tube 41 is provided in the hollow portion 42*a* of the thermal tape 42. The paper tube 41 is a cylindrical member structured such that a projecting portion formed on the bottom face of the adapter body 21 is inserted in the hollow portion 41*a* of the paper tube 41 in a state where the print medium 40 is stored in the medium adapter 20. The paper tube 41 is useful to rotate the print medium 40 smoothly inside the medium adapter 20 without damaging the print medium 40 while the thermal tape 42 is being fed by the platen roller 7.

For example, the thermal tape 42 has a five-layer structure as illustrated in FIG. 5. In other words, the separator L1, an adhesive layer L2, a base material L3, a coloring layer L4, and a protective layer L5 are laminated in this order. The separator L1 is stuck peelably to the base material L3 to cover the adhesive layer L2. The material of the separator L1 is, for example, paper. However, the material is not limited to paper, and it may be PET (polyethylene terephthalate). The adhesive layer L2 is an adhesive material applied to the base material L3. The material of the base material L3 is, for example, colored PET. The coloring layer L4 is a heat-sensitive coloring layer which develops color by the application of heat energy. The material of the protective layer L5 is, for example, transparent PET.

The structure of the thermal tape 42 is not limited to the structure illustrated in FIG. 5. For example, the thermal tape 42 may be such that the coloring layer L4 is exposed without the protective layer L5.

In the state of being wound around the paper tube 41, the thermal tape 42 has a shape corresponding to the shape of the paper tube 41. In other words, the thermal tape 42 has a cylindrical shape, and both side faces (the side face 42*b* and the side face 42*c*) have an annular shape.

The loosening prevention sheet 43 is an adhesive sheet to maintain the shape of the thermal tape 42. The thermal tape 42 can expand by changes in humidity. However, since the loosening prevention sheet 43 is applied to the side face 42*c* of the thermal tape 42, shape variations of the thermal tape 42 due to expansion, that is, loosening of the thermal tape 42 can be suppressed. Further, even when an impact is exerted on the thermal tape 42 due to dropping of the print medium 40 or the like, the loosening prevention sheet 43 can suppress the shape variations.

The loosening prevention sheet 43 has an opening section 43*a* and an adhesive face 43*b*. The opening section 43*a* has a size equal to the hollow portion 41*a* of the paper tube 41 or larger than the hollow portion 41*a* of the paper tube 41. The loosening prevention sheet 43 is stuck on the side face 42*c* in such a manner that the opening section 43*a* faces the hollow portion 42*a* of the thermal tape 42. It is also desired that the loosening prevention sheet 43 should have such a size as to cover the side face 42*c* of the thermal tape 42. In other words, it is desired that the loosening prevention sheet 43 should be larger than the side face 42*c*. Thus, since the whole thermal tape 42 can be held on the adhesive face, the shape can be maintained more definitely.

Further, it is desired that the shape of the loosening prevention sheet 43 should be similar to the shape of the side face 42*c*. In other words, it is desired that, when the side face 42*c* has an annular shape, the loosening prevention sheet 43 should also have an annular shape. Thus, since such an area as not to contribute to maintaining the shape of the thermal tape 42 can be reduced, the size of the loosening prevention sheet 43 can be reduced. Further, since the exposure of the adhesive face is also reduced, the adhesion of dust, dirt, and the like to the loosening prevention sheet 43 can also be reduced.

The attention sheet 44 is an adhesive sheet indicative of the type of print medium 40 (more strictly, the type of thermal tape 42). There are various types of thermal tapes 42, depending on the difference in tape width and the color difference in surface to be printed. Since information for specifying the type is included in the attention sheet 44, the user can readily identify the type of print medium 40 by applying the attention sheet 44 to the side face 42*b* of the thermal tape 42.

The attention sheet 44 has an opening section 44*a* and an adhesive face 44*b*. The opening section 44*a* is smaller than the hollow portion 42*a* of the thermal tape 42, and further smaller than the hollow portion 41*a* of the paper tube 41. The attention sheet 44 is applied to the side face 42*b* in such a manner that the opening section 44*a* faces the hollow portion 42*a* of the thermal tape 42. It is desired that the attention sheet 44 should be smaller than the side face 42*b* of the thermal tape 42 at least before the start of use of the print medium 40, for example, at the time of sale of the print medium 40. More specifically, it is desired that the area of the attention sheet 44 should be smaller than the area of the side face 42*b* of the thermal tape 42. Thus, since an area covered with the attention sheet 44 on the side face 42*b* of the thermal tape 42 is reduced, it is easy to check the remaining amount of the thermal tape 42.

The material of the paper tube 41, the loosening prevention sheet 43, and the attention sheet 44 is not limited to paper. However, if these members are made of paper, the used print medium 40 after the thermal tape 42 is used up can be thrown away as a burnable waste. Therefore, it is desired that the material of the paper tube 41, the loosening prevention sheet 43, and the attention sheet 44 should be paper.

Figure 6:
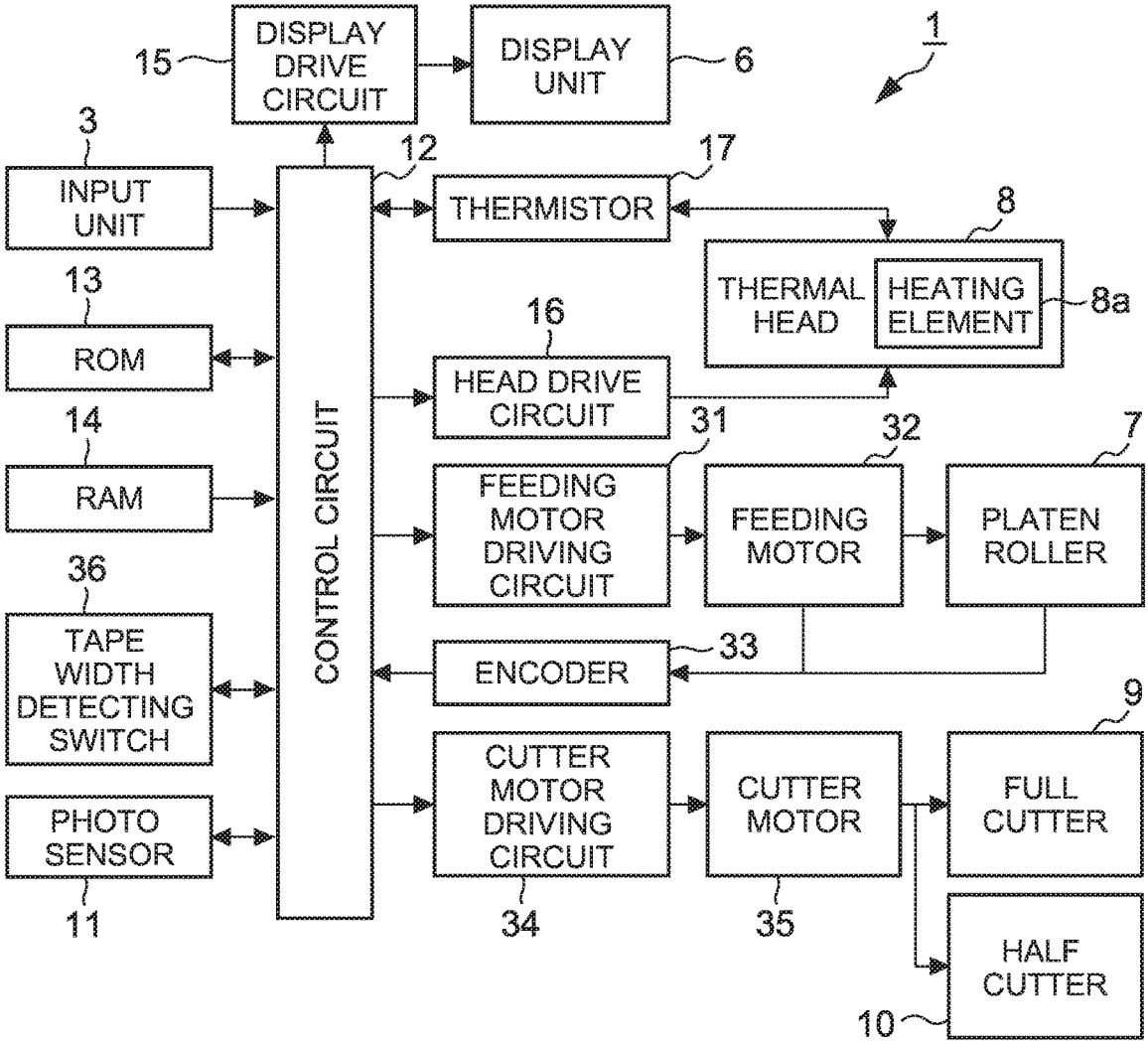
FIG. 6 is a block diagram illustrating the hardware configuration of the printing device 1.

FIG. 6 is a block diagram illustrating the hardware configuration of the printing device 1. As illustrated in FIG. 6, the printing device 1 includes, in addition to the components described above, the control circuit 12, a ROM (Read Only Memory) 13, a RAM (Random Access Memory) 14, a display drive circuit 15, a head drive circuit 16, a thermistor 17, a feeding motor driving circuit 31, the feeding motor 32, an encoder 33, a cutter motor driving circuit 34, a cutter motor 35, and a tape width detecting switch 36.

The control circuit 12 is a control unit including a processor such as a CPU (Central Processing Unit). The control circuit 12 expands, in the RAM 14, and executes a program stored in the ROM 13 to control the operation of each component of the printing device 1.

The program and various data (fonts and the like) necessary to execute the program are stored in the ROM 13. The RAM 14 is a working memory used to execute the program. Note that computer-readable recording media for storing the program and data used for processing in the printing device 1 include physical (non-transitory) recording media such as the ROM 13 and the RAM 14.

The display drive circuit 15 is a liquid crystal display driver circuit or an organic EL display driver circuit. The display drive circuit 15 controls the display unit 6 based on display data stored in the RAM 14.

The head drive circuit 16 controls the energization of the heating elements 8*a* in the thermal head 8 based on print data and a control signal under the control of the control circuit 12. The thermal head 8 is a print head having multiple heating elements 8*a* arrayed in the main scanning direction. The thermal head 8 heats the thermal tape 42 using the heating elements 8*a* to perform printing one line by one line. The thermistor 17 is embedded in the thermal head 8. The thermistor 17 measures the temperature of the thermal head 8.

The feeding motor driving circuit 31 drives the feeding motor 32 under the control of the control circuit 12. The feeding motor 32 may be, for example, a stepping motor or a direct-current (DC) motor. The feeding motor 32 rotates the platen roller 7. Note that the feeding motor 32 rotates, under the control of the feeding motor driving circuit 31, not only in the forward direction as a direction to send out the thermal tape 42 but also in the backward direction as a direction to rewind the thermal tape 42.

The platen roller 7 is a feeding roller which rotates by the driving force of the feeding motor 32 to feed the thermal tape 42 along the longitudinal direction (sub-scanning direction, feeding direction) of the thermal tape 42. When the feeding motor 32 rotates in the forward direction, the platen roller 7 sends out the thermal tape 42 from the medium adapter 20, while when the feeding motor 32 rotates in the backward direction, the platen roller 7 rewinds the thermal tape 42 being sent out from the medium adapter 20.

In other words, the control circuit 12 in the printing device 1 is a control unit which controls the feeding motor 32 through the feeding motor driving circuit 31 to control the platen roller 7.

The encoder 33 outputs, to the control circuit 12, a signal according to the driving amount (rotation amount) of the feeding motor 32 or the platen roller 7. The encoder 33 may be provided to the rotating shaft of the feeding motor 32, or may be provided to the rotating shaft of the platen roller 7. The control circuit 12 can specify the feeding amount of the thermal tape 42 based on the signal from the encoder 33.

When the feeding motor 32 is a stepping motor, the control circuit 12 may specify the feeding amount based on a signal (input pulse number) input to the feeding motor driving circuit 31 that drives the feeding motor 32. Thus, when the feeding motor 32 is the stepping motor, the encoder 33 may be omitted and the control circuit 12 may specify the feeding amount based on the signal (input pulse number) input to the feeding motor driving circuit 31.

The cutter motor driving circuit 34 drives the cutter motor 35 under the control of the control circuit 12. The full cutter 9 is operated by the power of the cutter motor 35 to cut the thermal tape 42 so as to create a tape piece. The half cutter 10 is operated by the power of the cutter motor 35 to cut layers (L2 to L4) except the separator L1 in the thermal tape 42.

The tape width detecting switch 36 is a switch provided in the medium adapter storage part 2*a* to detect the width of the thermal tape 42 stored in the medium adapter 20 based on the shape of the medium adapter 20. Plural tape width detecting switches 36 are provided in the medium adapter storage part 2*a*. Each of medium adapters 20, which corresponds to a different tape width, is structured to press down a different combination of plural tape width detecting switches 36, respectively. Thus, the control circuit 12 specifies each type of medium adapter 20 from the combination of tape width detecting switches 36 pressed down to detect the width (tape width) of the thermal tape 42 stored in the medium adapter 20. Note that the tape width detecting switches 36 are an example of an information acquisition unit which acquires information on the print medium 40, and the width of the thermal tape 42 is an example of the information on the print medium 40.

Figure 7:
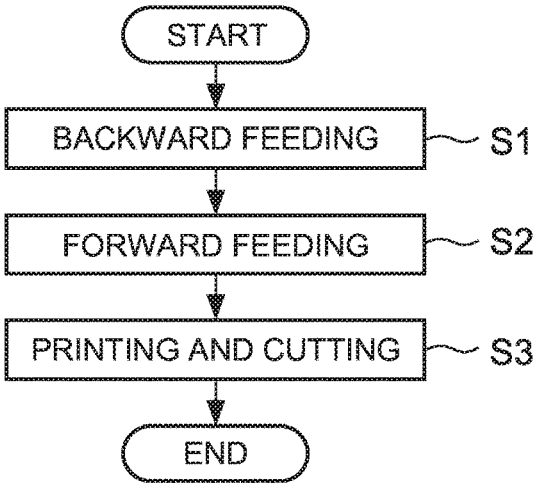
FIG. 7 is an example of a flowchart illustrating an overview of processing performed by the printing device 1.

FIG. 7 is an example of a flowchart illustrating an overview of processing performed by the printing device 1. In the printing device 1 described above, when a print command is input, the control circuit 12 starts processing illustrated in FIG. 7.

First, the control circuit 12 rotates the platen roller 7 backward to feed the thermal tape 42 in the backward direction (step S1). After that, the control circuit 12 rotates the platen roller 7 forward to feed the thermal tape 42 in the forward direction (step S2), and controls the thermal head 8 and the cutting mechanism (full cutter 9, half cutter 10) to perform printing on and cutting the thermal tape 42 (step S3).

In the printing device 1, as illustrated in FIG. 7, the thermal tape 42 is first fed in the backward direction. This can lead to adjusting the size of a margin between a tip 42T of the thermal tape 42 and a printing area PA. This can prevent a margin more than necessary from being formed. Note that the printing area PA is an area on the thermal tape 42 in which printing is performed by the thermal head 8.

Figure 8:
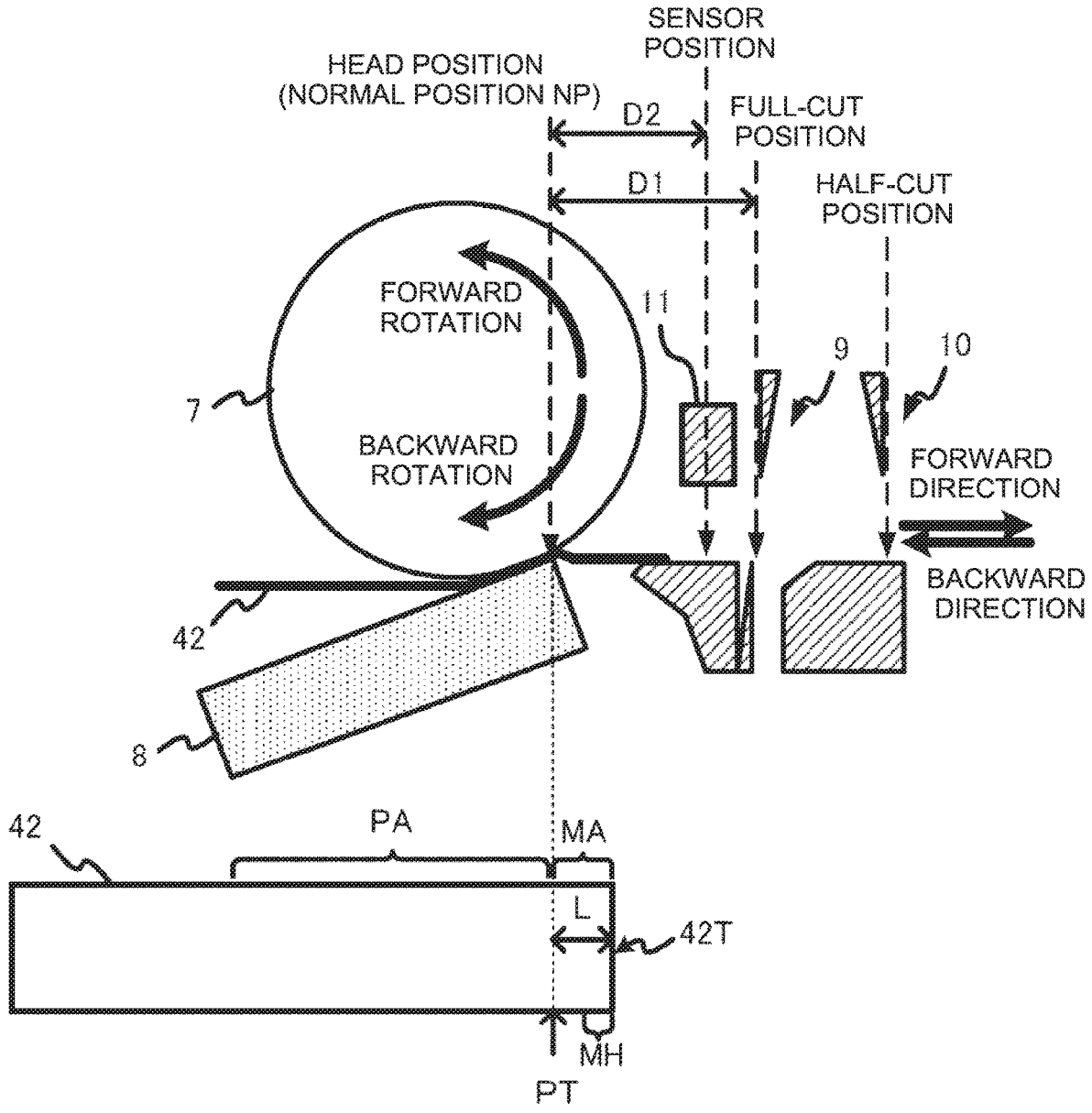
FIG. 8 is a diagram illustrating relations among a half-cut position, a full-cut position, a sensor position, and a head position.
Figure 9:
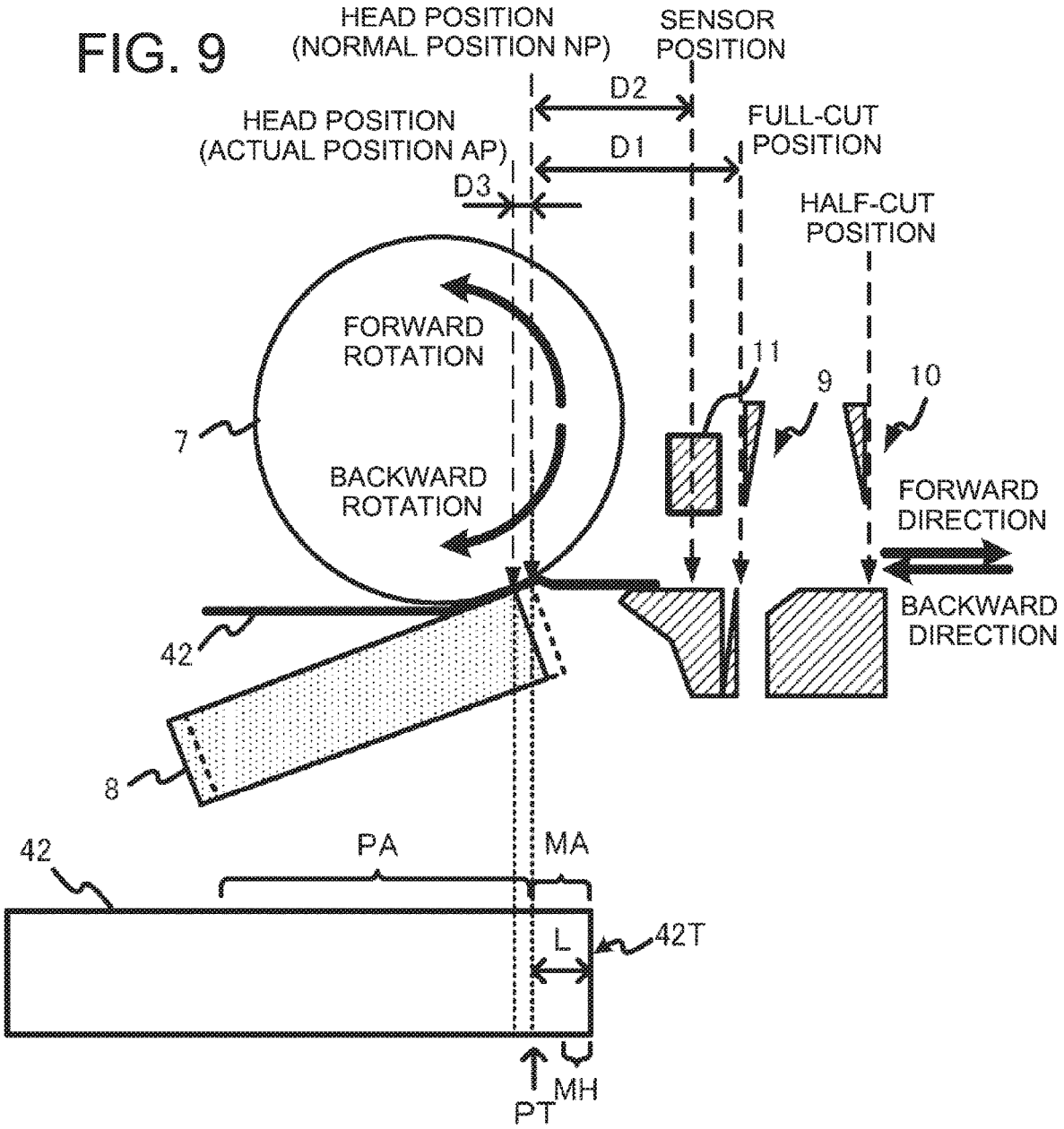
FIG. 9 is a diagram for describing a deviation of the head position.
Figure 10:
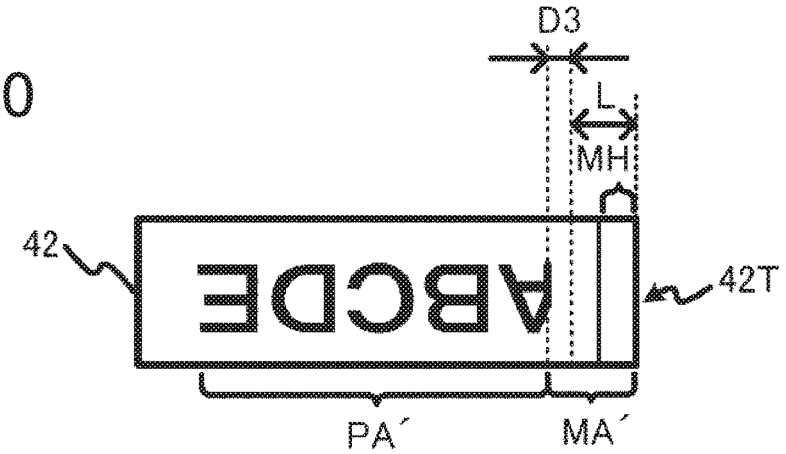
FIG. 10 is a diagram for describing the influence of the deviation of the head position on the printing result.

FIG. 8 is a diagram illustrating relations among a half-cut position, a full-cut position, a sensor position, and a head position. FIG. 9 is a diagram for describing a deviation of the head position. FIG. 10 is a diagram for describing the influence of the deviation of the head position on the printing result. Referring to FIG. 8 to FIG. 10, the backward feeding in step S1 of FIG. 7 will be described in further detail below.

A case is first considered where the thermal tape 42 is fed backward by the platen roller 7 until the top PT of the printing area PA reaches a normal position NP. Note that the top PT of the printing area PA is also called a printing start position.

In this case, as illustrated in FIG. 8, the head position of the thermal head 8 (i.e., the position of the heating elements 8*a*) coincides with the top PT of the printing area PA, and it seems that normal printing and the formation of an appropriate-sized margin can be achieved. Note that a margin MA having a length L illustrated in FIG. 8 indicates the appropriate-sized margin, which includes a margin MH for a half cut when the half cut is performed to make it easy to peel off the separator L1 from the thermal tape 42.

However, when the top PT is fed to the normal position NP, a situation may actually occur where normal printing is not performed and a margin more than expected is formed. This is caused by the fact that the thermal head 8 moves a short distance D3 (e.g., 0.1 mm to 0.5 mm) upstream of the feeding direction from the normal position NP as illustrated in FIG. 9 as a result of the application of abnormal stress to the thermal head 8 due to the backward feeding of the thermal tape 42 to change the position of the thermal head 8 to a position (actual position AP) deviated from the normal position NP. In other words, even if the user intended to align the top PT of the printing area PA with the position of the thermal head 8, the thermal head 8 (more strictly, the heating elements 8*a*) would be actually located upstream of the top PT in the feeding direction.

When the thermal head 8 is located upstream of the top PT of the printing area PA in the feeding direction, the printing device 1 cannot start printing from the top PT. Therefore, as illustrated in FIG. 10, a margin MA' larger than the planned length L is formed.

Further, when feeding of the thermal tape 42 in the backward direction is completed and feeding in the forward direction is started, the direction of stress applied to the thermal head 8 is changed. This causes the thermal head 8 at the position AP to return to the normal position NP. Since the thermal tape 42 and the thermal head 8 move together during a period when the thermal head 8 is moving from the position AP toward the normal position NP, the position of the thermal tape 42 relative to the thermal head 8 does not change. As a result, printing of several lines performed during this period is done at the same position of the thermal tape 42. Therefore, as illustrated in FIG. 10, since the top part (see the part of letter "A") is crushed, i.e., so-called printing clogging occurs, the correct printing result cannot be obtained, or a printing area PA' shorter than the planned length is formed.

Therefore, in step S1, the control circuit 12 rotates the platen roller 7 backward until the top PT of the printing area PA reaches a position more away from the outlet 2*b* than the normal position NP (hereinafter, this position is referred to as a backward feed position). This backward feed position is a position corresponding to the amount of movement, where the thermal head 8 is estimated to be deviated from the normal position NP with the backward rotation of the platen roller 7. For example, it is desired that the position should be a position the distance D3 or more (e.g., 0.75 mm) away from the normal position NP, where the distance D3 indicates the amount of movement of the thermal head 8. Further, the backward feed position may be a position a predetermined distance more away from the outlet 2*b* than the normal position NP. In this case, it is desired that the predetermined distance should be a distance corresponding to the estimated maximum of movement or more.

Thus, upon completion of step S1, the position of the thermal head 8 is the same position as the top PT of the printing area PA, or the thermal head 8 is located downstream of the top PT in the feeding direction. Therefore, a period from the start of feeding in the forward direction until the start of printing can be adjusted to start printing from the top PT, and hence the formation of a margin more than expected can be avoided. In other words, when the printing start area reaches the normal position NP by the forward rotation of the platen roller 7, the control circuit 12 causes the thermal head 8 to start printing on the thermal tape 42.

Further, in step S2, although the thermal head 8 and the thermal tape 42 move together during a period until the thermal head 8 returns to the normal position NP, the thermal head 8 reaches the normal position NP ahead of the top PT of the printing area PA. Therefore, printing from the top PT can be performed in such a state that the thermal head 8 is located at the normal position NP. Thus, printing from the top PT of the printing area PA can be started to obtain the correct printing result while avoiding printing clogging.

When the tip 42T of the thermal tape 42 is at the full-cut position, it is only necessary to feed the thermal tape 42 backward by an amount of difference (D1−L) of a distance D1 between the full-cut position and the normal position NP, and the length L of the margin MA in order to feed the top PT to the normal position NP. When the tip 42T of the thermal tape 42 is not at the full-cut position, it is only necessary to feed the thermal tape 42 backward by an amount of difference (D2−L) of a distance D2 between the photo sensor 11 and the normal position NP, and the length L after starting feeding in the backward direction and detecting the tip 42T of the thermal tape 42 using the photo sensor 11.

Therefore, for example, when the tip 42T of the thermal tape 42 is at the full-cut position, it is only necessary to perform feeding in the backward direction by an amount of D1+D3−L in order to feed the thermal tape 42 so that the top PT will be located at the distance D3 further upstream of the normal position NP. When the tip 42T of the thermal tape 42 is not at the full-cut position, it is only necessary to perform feeding in the backward direction by an amount of D2+D3−L after starting feeding in the backward direction and detecting the tip 42T of the thermal tape 42 using the photo sensor 11.

Figure 11:
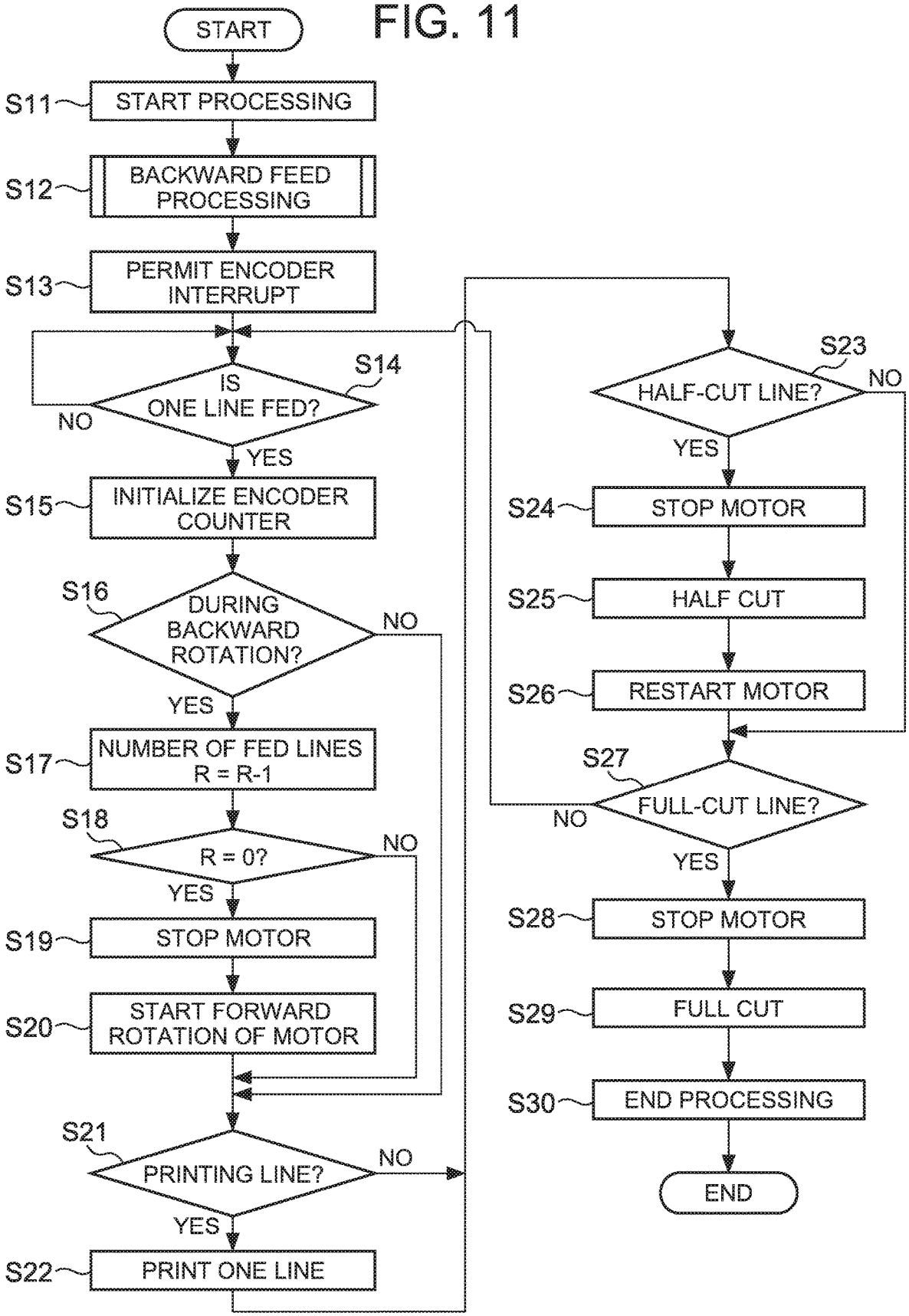
FIG. 11 is an example of a flowchart of processing performed by the printing device 1.
Figure 12:
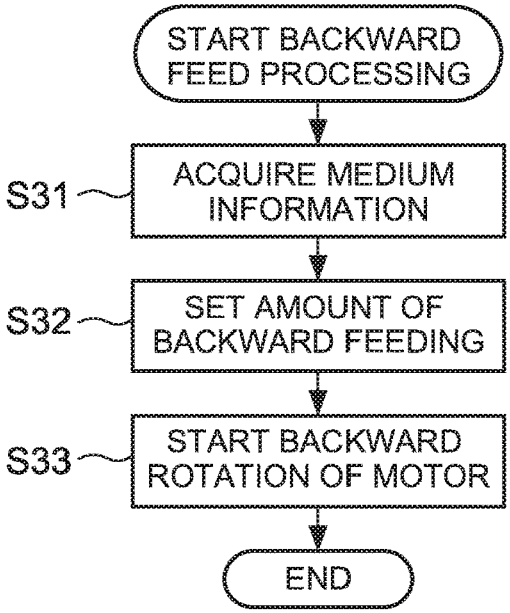
FIG. 12 is an example of a flowchart of backward feed processing.

FIG. 11 is an example of a flowchart of processing performed by the printing device 1. FIG. 12 is an example of a flowchart of backward feed processing. Referring to FIG. 11 and FIG. 12, a specific example of processing illustrated in FIG. 7 and performed by the printing device 1 will be described below. Note that the processing illustrated in FIG. 11 is an example of a control method of the printing device 1.

When the print command is input, the control circuit 12 first performs start processing (step S11). Here, the control circuit 12 performs parameter initialization processing and the like necessary for processing to be described later. After that, the control circuit 12 performs backward feed processing illustrated in FIG. 12 (step S12).

In the backward feed processing of step S12, the control circuit 12 first acquires medium information (step 31). More specifically, for example, the control circuit 12 acquires information indicative of the width of the thermal tape 42 from the tape width detecting switches 36.

Next, the control circuit 12 sets the amount of feeding in the backward direction based on the medium information (step S32), and further sets the number of fed lines, R, obtained by converting the amount of feeding into the number of lines. Note that setting of the amount of feeding corresponds to deciding on the backward feed position required for the top PT of the printing area PA to reach by backward feeding. In other words, in this step, the control circuit 12 decides on the backward feed position based on the information acquired in step S31. Note that the backward feed position is a position at least more away from the outlet 2*b* than the normal position NP.

When the information acquired in step S31 is information indicative of the width of the thermal tape 42, the backward feed position may be decided according to the width in step S32. More specifically, the amount of feeding can be set larger as the width is narrower. For example, it can be such that, when the width of the thermal tape 42 is 12 mm or 18 mm, the top PT is fed to a position 0.5 mm upstream of the normal position NP, while when the width of the thermal tape 42 is 6 mm or 9 mm, the top PT is fed to a position 0.75 mm upstream of the normal position NP. Further, the top PT can be fed to a position 0.75 mm upstream of the normal position NP equally to fit the narrowest printable width of the thermal tape 42. This is because the narrower the width of the thermal tape 42, the larger the area of direct contact between the thermal head 8 and the platen roller 7, and hence the higher the possibility that large stress will be applied to the thermal head 8. When the information acquired in step S31 is information on the material of the thermal tape 42, the amount of feeding can be set larger as the material produces a larger frictional force. Further, when the information acquired in step S31 is information on the thickness of the thermal tape 42, the amount of feeding can be set larger as the thickness is thinner.

When the amount of feeding in the backward direction is set, the control circuit 12 controls the feeding motor drive circuit 31 to start the backward rotation of the feeding motor 32 (platen roller 7) (step S33), and ends the backward feed processing illustrated in FIG. 12.

After that, the control circuit 12 permits interrupt processing by a signal from the encoder 33 (step S13), and monitors the amount of feeding to detect the feeding of one line (step S14). In the interrupt processing, a value held by an unillustrated encoder counter for counting the number of signal inputs is incremented each time the signal is input from the encoder 33. In step S14, the feeding of one line is detected when the value held by the encoder counter reaches a predetermined number (e.g., 4). When the feeding of one line is detected (YES in step S14), the encoder counter is initialized (step S15), and the value of the encoder counter is reset.

When the feeding of one line is detected, the control circuit 12 first determines whether the feeding motor 32 (platen roller 7) is during the backward rotation or not (step S16). When it is not during the backward rotation (NO in step S16), the control circuit 12 proceeds to step S21.

When it is during the backward rotation (YES in step S16), the control circuit 12 decrements, by one, the number of fed lines, R (step S17), and determines whether the number of fed lines, R, after being decremented by one is 0 or not (step S18). When the number of fed lines, R, is 0 (YES in step S18), since this means that feeding in the backward direction by the amount of feeding set in step S12 is completed, the control circuit 12 controls the feeding motor drive circuit 31 to stop the backward rotation of the feeding motor 32 (platen roller 7) (step S19). After that, the control circuit 12 rotates the feeding motor 32 (platen roller 7) forward to start the feeding of the thermal tape 42 in the forward direction (step S20), and proceeds to step S21. On the other hand, when the number of fed lines, R, is not 0 (NO in step S18), the control circuit 12 proceeds to step S21 without stopping the backward rotation of the feeding motor 32.

In step S21, the control circuit 12 determines whether the current line is a printing line or not (step S21). Note that the printing line means a line in the printing area PA. When the current line is the printing line, the control circuit 12 controls the head drive circuit 16 to drive the thermal head 8 in order to perform one-line printing on the thermal tape 42 (step S22).

Further, the control circuit 12 determines whether the current line is a half-cut line or not (step S23). Note that the half-cut line means a line half cut by the half cutter 10. Specifically, it is a line located upstream of the tip 42T of the thermal tape 42 in the feeding direction by a length of the margin MH. When the current line is the half-cut line, the control circuit 12 controls the feeding motor drive circuit 31 to pause the forward rotation of the feeding motor 32 (step S24). Then, the control circuit 12 controls the cutter motor driving circuit 34 to drive the half cutter 10 to make a half cut (step S25). After that, the control circuit 12 resumes the forward rotation of the feeding motor 32 to restart feeding the thermal tape 42 in the forward direction (step S26).

Further, the control circuit 12 determines whether the current line is a full-cut line or not (step S27). Note that the full-cut line means a line fully cut by the full cutter 9. When the current line is not the full-cut line, the control circuit 12 returns to step S14 to repeat the above-described processing. On the other hand, when the current line is the full-cut line, the control circuit 12 controls the feeding motor drive circuit 31 to pause the forward rotation of the feeding motor 32 (step S28). Then, the control circuit 12 controls the cutter motor driving circuit 34 to perform a full cut by the full cutter 9 (step S29). After that, end processing is performed (step S30) to end the processing illustrated in FIG. 11.

Since the processing illustrated in FIG. 11 and FIG. 12 is performed by the printing device 1, forward feeding is started after the top PT of the printing area PA reaches the backward feed position more away from the outlet 2*b* than the normal position NP by the backward feeding. Further, the control circuit 12 causes the thermal head 8 to start printing on the thermal tape 42 after the top PT reaches the normal position NP by the forward rotation of the platen roller 7. Thus, even when printing is performed after the thermal tape 42 is fed in the backward direction, the correct printing result can be obtained without printing clogging.

Further, as illustrated in FIG. 12, the control circuit 12 decides on the backward feed position based on the information on the thermal tape 42 so that the amount of backward feeding can be changed depending on the type of thermal tape 42. Thus, the correct printing result can be always obtained regardless of the type of thermal tape 42. Further, the amount of backward feeding can be minimized according to the type of thermal tape 42. This can reduce the time after the print command is input until the start of feeding in the forward direction, and hence the printing time can be reduced.

Figure 13:
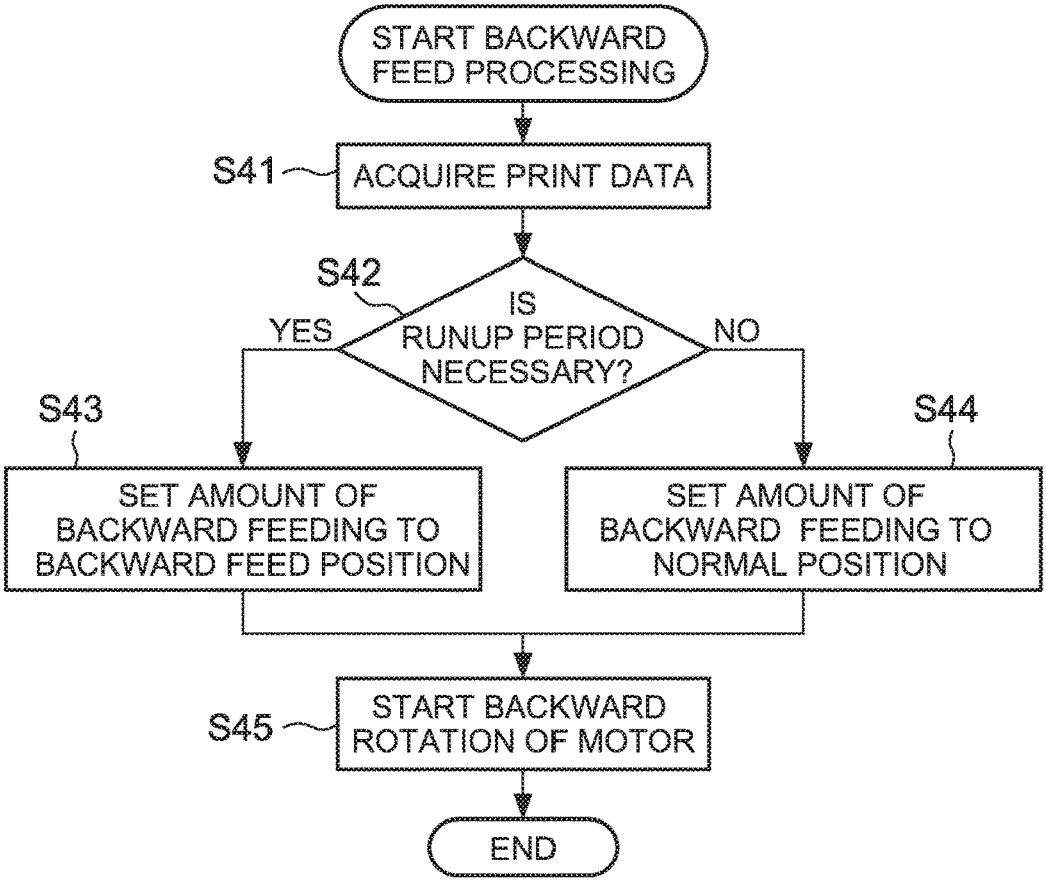
FIG. 13 is another example of the flowchart of backward feed processing.

FIG. 13 is another example of the flowchart of the backward feed processing. The control circuit 12 can perform backward feed processing illustrated in FIG. 13 instead of the backward feed processing illustrated in FIG. 12.

In the backward feed processing illustrated in FIG. 13, the control circuit 12 first acquires print data (step S41), and determines the necessity of a runup period based on the print data (step S42). Note that the runup period means a period after the start of the forward rotation of the platen roller 7 until the start of printing control of the thermal head 8 based on the print data. In other words, the runup period is a period during the feeding period in the forward direction, where only feeding is performed without performing printing.

In step S42, the control circuit 12 may determine the necessity of the runup period based, for example, on whether or not the content of print data includes a blank section from the top PT longer than the distance D3. Suppose that the blank section from the top PT is shorter than the distance D3. In this case, when the printing control of the thermal head 8 is started simultaneously with the forward rotation of the platen roller 7, since voltage is applied to the heating elements 8*a* before the thermal head 8 returns to the normal position NP, printing clogging is likely to occur. Therefore, the control circuit 12 determines that the runup period is necessary. On the other hand, suppose that the blank section from the top PT is the distance D3 or more. In this case, even when the printing control of the thermal head 8 is started simultaneously with the forward rotation of the platen roller 7, since voltage is not applied to the heating elements 8*a* before the thermal head 8 returns to the normal position NP, there is no possibility that printing clogging occurs. Therefore, the control circuit 12 determines that the runup period is unnecessary.

When it is determined in step S42 that the runup period is necessary (YES in step S42), the control circuit 12 sets the amount of backward feeding to the backward feed position (step S43), controls the feeding motor drive circuit 31 to start the backward rotation of the feeding motor 32 (platen roller 7) (step S45), and ends the backward feed processing illustrated in FIG. 13. Thus, like in the case where the backward feed processing illustrated in FIG. 12 is performed, the control circuit 12 rotates the platen roller 7 backward until the top PT of the printing area PA reaches the backward feed position before the start of printing.

When it is determined in step S42 that the runup period is unnecessary (NO in step S42), the control circuit 12 sets the amount of backward feeding to the normal position NP (step S44), controls the feeding motor drive circuit 31 to start the backward rotation of the feeding motor 32 (platen roller 7) (step S45), and ends the backward feed processing illustrated in FIG. 13. Thus, unlike in the case where the backward feed processing illustrated in FIG. 12 is performed, the control circuit 12 rotates the platen roller 7 backward until the top PT of the printing area PA reaches the normal position NP before the start of printing.

Since the control circuit 12 performs the backward feed processing illustrated in FIG. 13 instead of the backward feed processing illustrated in FIG. 12, the required amount of backward feeding can be decided in consideration of the print data. Thus, the correct printing result can be obtained while preventing wasteful backward feeding.

The above-described embodiment is a specific example to facilitate the understanding of the invention, and the present invention is not limited to the embodiment. The printing device, the control method, and the program can be modified and changed in various ways without departing from the scope of the appended claims.

In the above-described embodiment, although the printing device 1 having the input unit 3 and the display unit 6 is exemplified, the printing device may not have the input unit and the display unit, and may receive the print data and the print command from an electronic device different from the printing device.

In the above-described embodiment, the tape width detecting switches 36 are exemplified as an example of the medium information acquisition unit, but the medium information acquisition unit is not limited to the tape width detecting switches 36. For example, the printing device 1 may include, as the medium information acquisition unit, a reader which reads QR Code (registered trademark) or an IC tag stuck on the medium adapter 20 or the print medium 40.

Further, in the above-described embodiment, for example, the example in which the amount of backward feeding is decided based on the medium information is illustrated in FIG. 12, and the other example in which the amount of backward feeding is decided based on the print data is illustrated in FIG. 13, but the amount of backward feeding may also be decided based on both the medium information and the print data. Further, in FIG. 13, the amount of backward feeding is decided depending on whether the blank section of the print data is longer than the distance D3 as the amount of deviation of the thermal head 8, but the amount of backward feeding may be set small corresponding to the length of the blank section.

What is claimed is:

1. A printing device comprising:

a feeding roller which feeds a print medium;

a print head which performs printing on the print medium; and a control unit which, under control of a stored program, is configured to control execution of processes comprising:

determining a backward feed position, the backward feed position corresponding to an amount of movement by which the print head deviates from a normal position thereof when the print medium is fed backward by backward rotation of the feeding roller, and the backward feed position being further away from an outlet of the printing device than the normal position of the print head;

rotating the feeding roller backward to feed the print medium backward until it is determined that a printing start area of the print medium corresponds to the backward feed position; and after determining that the printing start area of the print medium corresponds to the backward feed position, rotating the feeding roller forward to perform printing using the print head.

2. The printing device according to claim 1, further comprising an information acquisition unit which acquires information on the print medium, wherein the control unit is configured to determine the backward feed position based on the information acquired by the information acquisition unit.

3. The printing device according to claim 2, wherein:

the information acquisition unit includes a width detection unit which detects a width of the print medium, and the control unit is configured to determine the backward feed position according to the width of the print medium.

4. The printing device according to claim 3, wherein the control unit is configured to, in a case in which the detected width of the print medium is a first width, set the backward feed position as a position more away from the outlet than a position set in a case in which the detected width of the print medium is a second width wider than the first width.

5. The printing device according to claim 1, wherein the backward feed position is a position a predetermined distance more away from the outlet than the normal position of the print head.

6. The printing device according to claim 5, wherein the predetermined distance is at least a distance corresponding to an estimated maximum of movement.

7. The printing device according to claim 1, wherein the control unit is configured to cause the print head to start printing on the print medium when the printing start area reaches the normal position by forward rotation of the feeding roller.

8. The printing device according to claim 1, wherein the control unit is configured to:

determine, based on print data, of whether a runup period from a start of forward rotation of the feeding roller until a start of printing using the print head is necessary, when determining that the runup period is necessary, rotate the feeding roller backward to make the printing start area reach the backward feed position before the start of printing, and when determining that the runup period is unnecessary, rotate the feeding roller backward to make the printing start area reach the normal position before the start of printing.

9. A control method executed by a printing device including a feeding roller which feeds a print medium, a print head which performs printing on the print medium, and a control unit, the method being executed under control of the control unit, and the method comprising:

determining a backward feed position, the backward feed position corresponding to an amount of movement by which the print head deviates from a normal position thereof when the print medium is fed backward by backward rotation of the feeding roller, and the backward feed position being further away from an outlet of the printing device than the normal position of the print head;

rotating the feeding roller backward to feed the print medium backward until it is determined that a printing start area of the print medium corresponds to the backward feed position; and after determining that the printing start area of the print medium corresponds to the backward feed position, rotating the feeding roller forward to perform printing using the print head.

10. A non-transitory recording medium recording a computer-readable program executed by a printing device including a feeding roller which feeds a print medium, a print head which performs printing on the print medium, and a processor, the program being executable by the processor to control the processor to execute control of processes comprising:

determining a backward feed position, the backward feed position corresponding to an amount of movement by which the print head deviates from a normal position thereof when the print medium is fed backward by backward rotation of the feeding roller, and the backward feed position being further away from an outlet of the printing device than the normal position of the print head;

rotating the feeding roller backward to feed the print medium backward until it is determined that a printing start area of the print medium corresponds to the backward feed position; and after determining that the printing start area of the print medium corresponds to the backward feed position, rotating the feeding roller forward to perform printing using the print head.

* * * * *